US012490881B2

(12) United States Patent
Aguiar, Jr.

(10) Patent No.: US 12,490,881 B2
(45) Date of Patent: Dec. 9, 2025

(54) DISPENSING CUP MONITORING FOR A DISHWASHER APPLIANCE

(71) Applicant: Haier US Appliance Solutions, Inc., Wilmington, DE (US)

(72) Inventor: Ricardo Alberto Aguiar, Jr., Clarksville, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 216 days.

(21) Appl. No.: 18/458,718

(22) Filed: Aug. 30, 2023

(65) Prior Publication Data

US 2025/0072709 A1 Mar. 6, 2025

(51) Int. Cl.

| | |
|---|---|
| ***A47L 15/44*** | (2006.01) |
| ***A47L 15/00*** | (2006.01) |
| ***A47L 15/42*** | (2006.01) |

(52) U.S. Cl.

CPC ..... *A47L 15/4409* (2013.01); *A47L 15/0063* (2013.01); *A47L 15/4259* (2013.01); *A47L 15/4293* (2013.01)

(58) Field of Classification Search

None

See application file for complete search history.

(56) References Cited

U.S. PATENT DOCUMENTS

| | | | |
|---|---|---|---|
| 2016/0296100 | A1 | 10/2016 | Anderson et al. |
| 2023/0015422 | A1 | 1/2023 | Aguiar, Jr. et al. |

FOREIGN PATENT DOCUMENTS

| | | | |
|---|---|---|---|
| DE | 10204455 | A1 | 8/2003 |
| WO | WO2011039245 | A2 | 4/2011 |

*Primary Examiner* — Rita P Adhlakha

(74) *Attorney, Agent, or Firm* — Dority & Manning, P.A.

(57) ABSTRACT

A dishwasher appliance includes a door pivotally mounted to a cabinet to provide selective access to a wash chamber, a dispensing assembly including a dispenser cup, a dispenser door for providing selective access to the dispenser cup, and an actuating mechanism for moving the dispenser door from a closed position to an open position, and a microphone for monitoring sound generated during operation of the dishwasher appliance. A controller is configured to energize the actuating mechanism, obtain a sound signal generated during energization of the actuating mechanism and/or a power draw from the actuating mechanism, determine that the dispensing assembly has malfunctioned based at least in part on the sound signal or the power draw, and implement a responsive action.

20 Claims, 6 Drawing Sheets

DISPENSING CUP MONITORING FOR A DISHWASHER APPLIANCE

FIELD OF THE INVENTION

The present subject matter relates generally to dishwasher appliances, and more particularly, to systems and methods for monitoring an additive dispenser of a dishwasher appliance.

BACKGROUND OF THE INVENTION

Dishwasher appliances generally include a tub that defines a wash chamber. Rack assemblies can be mounted within the wash chamber of the tub for receipt of articles for washing. Wash fluid (e.g., various combinations of water and detergent along with optional additives) may be introduced into the tub where it collects in a sump space at the bottom of the wash chamber. During wash and rinse cycles, a pump may be used to circulate wash fluid to spray assemblies within the wash chamber that can apply or direct wash fluid towards articles disposed within the rack assemblies in order to clean such articles. During a drain cycle, a pump may periodically discharge soiled wash fluid that collects in the sump space and the process may be repeated.

Wash additives, such as detergent or other wash aides, are commonly placed in a dispensing cup on an inner side of a door of the dishwasher appliance. The wash additive is often contained within the dispensing cup by a dispenser door until a particular time during the operating cycle when it is desirable to inject the detergent. At the target dispensing time, a door latch may be released so that the dispenser door opens, and the detergent is dispensed. However, conventional dishwashers commonly experience dispenser door failures, e.g., due to soap buildup, faulty actuators, power failures, etc. Moreover, conventional dishwashers have no way to detect whether the dispenser door opened properly, resulting in wash cycles being performed without detergent, thereby degrading wash performance and causing user dissatisfaction.

Accordingly, a dishwasher appliance with an improved additive dispensing system is desired. More specifically, a dispensing system that uses feedback to determine whether the dispenser cup operated properly would be particularly beneficial.

BRIEF DESCRIPTION OF THE INVENTION

Aspects and advantages of the invention will be set forth in part in the following description, or may be obvious from the description, or may be learned through practice of the invention.

In one exemplary embodiment, a dishwasher appliance defining a vertical direction, a lateral direction, and a transverse direction is provided. The dishwasher appliance includes a wash tub positioned within a cabinet and defining a wash chamber, a door pivotally mounted to the cabinet to provide selective access to the wash chamber, a dispensing assembly comprising a dispenser cup, a dispenser door for providing selective access to the dispenser cup, and an actuating mechanism for moving the dispenser door from a closed position to an open position, a microphone for monitoring sound generated during operation of the dishwasher appliance, and a controller in operative communication with the dispensing assembly and the microphone. The controller is configured to energize the actuating mechanism, obtain a sound signal generated during energization of the actuating mechanism, determine that the dispensing assembly has malfunctioned based at least in part on the sound signal, and implement a responsive action in response to determining that the dispensing assembly has malfunctioned based at least in part on the sound signal.

In another exemplary embodiment, a method of operating a dishwasher appliance is provided. The dishwasher appliance includes a dispensing assembly comprising a dispenser cup, a dispenser door for providing selective access to the dispenser cup, and an actuating mechanism for moving the dispenser door from a closed position to an open position, the dishwasher appliance further comprising a microphone for monitoring sound generated during operation of the dishwasher appliance. The method includes energizing the actuating mechanism, obtaining a sound signal generated during energization of the actuating mechanism, determining that the dispensing assembly has malfunctioned based at least in part on the sound signal, and implementing a responsive action in response to determining that the dispensing assembly has malfunctioned based at least in part on the sound signal.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
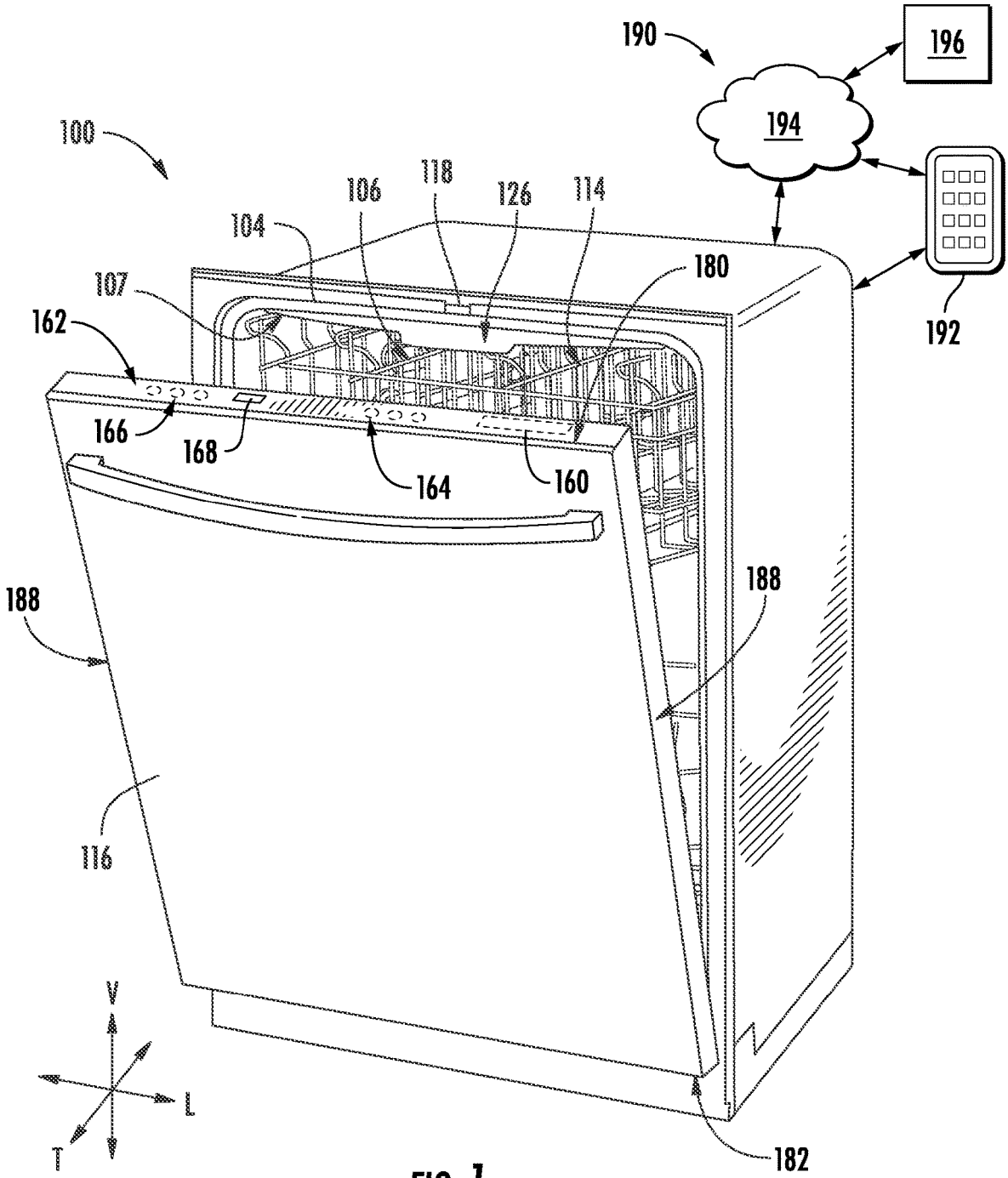
FIG. 1 provides a perspective view of a dishwasher appliance, including a dishwasher door according to an example embodiment of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. In addition, the term "or" is generally intended to be inclusive (i.e., "A or B" is intended to mean "A or B or both"). Furthermore, as used herein, terms of approximation, such as "approximately," "substantially," or "about," refer to being within a ten percent margin of error.

Figure 2:
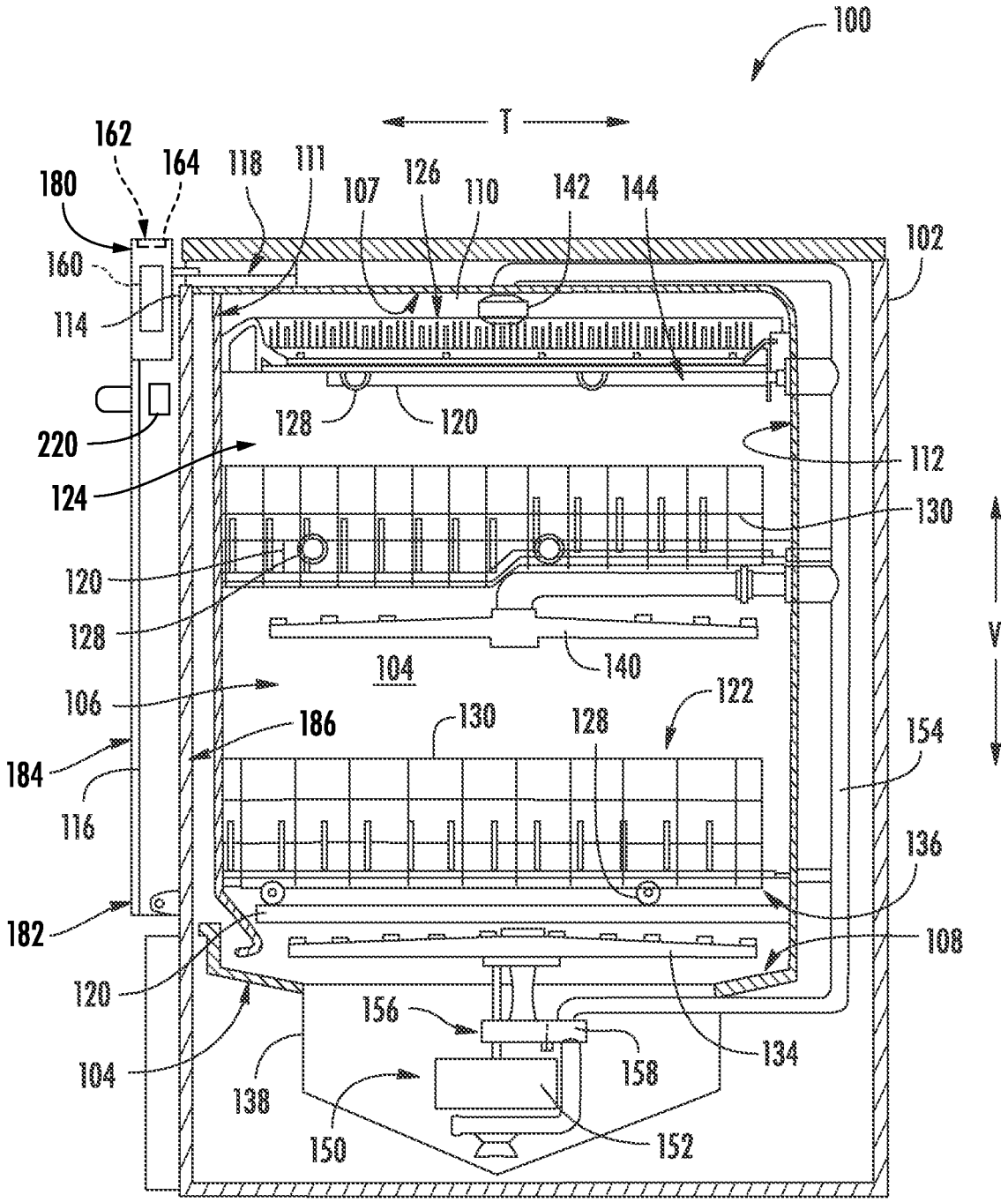
FIG. 2 provides a cross-sectional side view of the exemplary dishwashing appliance of FIG. 1 according to an example embodiment of the present disclosure.

FIGS. 1 and 2 depict an exemplary domestic dishwashing appliance or dishwasher 100 that may be configured in accordance with aspects of the present disclosure. For the particular embodiment of FIGS. 1 and 2, the dishwasher 100 includes a cabinet 102 having a tub 104 therein that defines a wash chamber 106. As shown, tub 104 extends between a top 107 and a bottom 108 along a vertical direction V, between a pair of side walls 110 along a lateral direction L, and between a front side 111 and a rear side 112 along a transverse direction T. Each of the vertical direction V, lateral direction L, and transverse direction T are mutually orthogonal to one another.

The tub 104 includes a front opening 114 and a door 116 hinged at its bottom for movement between a normally closed vertical position (shown in FIG. 2), wherein the wash chamber 106 is sealed shut for washing operation, and a horizontal open position for loading and unloading of articles from the dishwasher 100. According to exemplary embodiments, dishwasher 100 further includes a door closure mechanism or assembly 118 that is used to lock and unlock door 116 for accessing and sealing wash chamber 106.

As illustrated in FIG. 2, tub side walls 110 may accommodate a plurality of rack assemblies. More specifically, guide rails 120 may be mounted to side walls 110 for supporting a lower rack assembly 122, a middle rack assembly 124, and an upper rack assembly 126. As illustrated, upper rack assembly 126 is positioned at a top portion of wash chamber 106 above middle rack assembly 124, which is positioned above lower rack assembly 122 along the vertical direction V. Each rack assembly 122, 124, 126 is adapted for movement between an extended loading position (not shown) in which the rack is substantially positioned outside the wash chamber 106, and a retracted position (shown in FIGS. 1 and 2) in which the rack is located inside the wash chamber 106. This is facilitated, for example, by rollers 128 mounted onto rack assemblies 122, 124, 126, respectively. Although a guide rails 120 and rollers 128 are illustrated herein as facilitating movement of the respective rack assemblies 122, 124, 126, it should be appreciated that any suitable sliding mechanism or member may be used according to alternative embodiments.

Some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles (e.g., during a cleaning or rinsing cycle). According to another exemplary embodiment, a silverware basket (not shown) may be removably attached to a rack assembly (e.g., lower rack assembly 122) for placement of silverware, utensils, and the like, that are otherwise too small to be accommodated by rack 122.

Dishwasher 100 further includes a plurality of spray assemblies for urging a flow of water or wash fluid onto the articles placed within wash chamber 106. More specifically, as illustrated in FIG. 2, dishwasher 100 includes a lower spray arm assembly 134 disposed in a lower region 136 of wash chamber 106 and above a sump 138 so as to rotate in relatively close proximity to lower rack assembly 122. Similarly, a mid-level spray arm assembly 140 is located in an upper region of wash chamber 106 and may be located below and in close proximity to middle rack assembly 124. In this regard, mid-level spray arm assembly 140 may generally be configured for urging a flow of wash fluid up through middle rack assembly 124 and upper rack assembly 126. Additionally, an upper spray assembly 142 may be located above upper rack assembly 126 along the vertical direction V. In this manner, upper spray assembly 142 may be configured for urging or cascading a flow of wash fluid downward over rack assemblies 122, 124, and 126. As further illustrated in FIG. 2, upper rack assembly 126 may further define an integral spray manifold 144, which is generally configured for urging a flow of wash fluid substantially upward along the vertical direction V through upper rack assembly 126.

The various spray assemblies and manifolds described herein may be part of a fluid distribution system or fluid circulation assembly 150 for circulating water and wash fluid in the tub 104. More specifically, fluid circulation assembly 150 includes a pump 152 for circulating water or wash fluid (e.g., detergent, water, or rinse aid) in the tub 104. Pump 152 may be located within sump 138 or within a machinery compartment located below sump 138 of tub 104, as generally recognized in the art. Fluid circulation assembly 150 may include one or more fluid conduits or circulation piping for directing water or wash fluid from pump 152 to the various spray assemblies and manifolds. For example, as illustrated in FIG. 2, a primary supply conduit 154 may extend from pump 152, along rear 112 of tub 104 along the vertical direction V to supply wash fluid throughout wash chamber 106.

As illustrated, primary supply conduit 154 is used to supply wash fluid to one or more spray assemblies (e.g., to mid-level spray arm assembly 140 and upper spray assembly 142). However, it should be appreciated that according to alternative embodiments, any other suitable plumbing configuration may be used to supply wash fluid throughout the various spray manifolds and assemblies described herein. For example, according to another exemplary embodiment, primary supply conduit 154 could be used to provide wash fluid to mid-level spray arm assembly 140 and a dedicated secondary supply conduit (not shown) could be utilized to provide wash fluid to upper spray assembly 142. Other plumbing configurations may be used for providing wash fluid to the various spray devices and manifolds at any location within dishwasher appliance 100.

Each spray arm assembly 134, 140, 142, integral spray manifold 144, or other spray device may include an arrangement of discharge ports or orifices for directing wash fluid received from pump 152 onto dishes or other articles located in wash chamber 106. The arrangement of the discharge ports, also referred to as jets, apertures, or orifices, may provide a rotational force by virtue of wash fluid flowing through the discharge ports. Alternatively, spray arm assemblies 134, 140, 142 may be motor-driven, or may operate using any other suitable drive mechanism. Spray manifolds and assemblies may also be stationary. The resultant movement of the spray arm assemblies 134, 140, 142 and the spray from fixed manifolds provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only and are not limitations of the present subject matter.

In operation, pump 152 draws wash fluid in from sump 138 and pumps it to a diverter assembly 156 (e.g., which may be positioned within sump 138 of dishwasher appliance 100). Diverter assembly 156 may include a diverter disk (not shown) disposed within a diverter chamber 158 for selectively distributing the wash fluid to the spray arm assemblies 134, 140, 142 or other spray manifolds or devices. For example, the diverter disk may have a plurality of apertures that are configured to align with one or more outlet ports (not shown) at the top of diverter chamber 158. In this manner, the diverter disk may be selectively rotated to provide wash fluid to the desired spray device.

According to an exemplary embodiment, diverter assembly 156 is configured for selectively distributing the flow of wash fluid from pump 152 to various fluid supply conduits, only some of which are illustrated in FIG. 2 for clarity. More specifically, diverter assembly 156 may include four outlet ports (not shown) for supplying wash fluid to a first conduit for rotating lower spray arm assembly 134 in the clockwise direction, a second conduit for rotating lower spray arm assembly 134 in the counter-clockwise direction, a third conduit for spraying an auxiliary rack such as the silverware rack, and a fourth conduit for supply mid-level or upper spray assemblies 140, 142 (e.g., such as primary supply conduit 154).

The dishwasher 100 is further equipped with a controller 160 to regulate operation of the dishwasher 100. The controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 160 may be constructed without using a microprocessor (e.g., using a combination of discrete analog or digital logic circuitry, such as switches, amplifiers, integrators, comparators, flip-flops, AND gates, and the like) to perform control functionality instead of relying upon software.

The controller 160 may be positioned in a variety of locations throughout dishwasher 100. In the illustrated embodiment, the controller 160 may be located within a control panel area 162 of door 116, as shown in FIGS. 1 and 2. In such an embodiment, input/output ("I/O") signals may be routed between the control system and various operational components of dishwasher 100 along wiring harnesses that may be routed through the bottom of door 116. Typically, the controller 160 may be in operative communication with a user interface panel 164 through which a user may select various operational features and modes and monitor progress of the dishwasher 100. In one embodiment, the user interface 164 may represent a general purpose I/O ("GPIO") device or functional block. In certain embodiments, the user interface 164 includes input components 166, such as one or more of a variety of electrical, mechanical or electromechanical input devices including capacitive touch screens/buttons, rotary dials, push buttons, and touch pads. The user interface 164 may further include one or more display components 168, such as a digital display device or one or more indicator light assemblies designed to provide operational feedback to a user. The user interface 164 may be in communication with the controller 160 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For example, different locations may be provided for user interface 164, different configurations may be provided for rack assemblies 122, 124, 126, different spray arm assemblies 134, 140, 142 and spray manifold configurations may be used, and other differences may be applied while remaining within the scope of the present subject matter. Moreover, aspects of the present subject matter may be applied to other appliances as well, such as refrigerators, ovens, microwaves, etc.

Referring now generally to FIGS. 1 and 2, door 116 will be described according to exemplary embodiments of the present subject matter. Although door 116 is described herein as being used with dishwasher 100, it should be appreciated that door 116 or variations thereof may be used on any other suitable residential or commercial appliance. As described herein, door 116 may share a coordinate system with dishwasher 100, e.g., when door 116 is in the closed position (e.g., as shown in FIG. 2). Specifically, door 116 may define a vertical direction V, a lateral direction L. and a transverse direction T. Therefore, these directions may be used herein to refer to features of door 116 and its various components and sub-assemblies.

As shown, in the normally closed position, door 116 extends from a top end or top edge 180 to a bottom end or bottom edge 182 along the vertical direction V; from a front end 184 to a rear end 186 along the transverse direction T; and between two lateral ends 188 along the lateral direction L. According to exemplary embodiments, door 116 may be formed from one or more exterior panels that define an interior chamber of door 116. According to exemplary embodiments, the exterior panels of door 116 may be panels that are stamped from stainless steel or may be formed from any other suitably rigid material, such as thermoformed plastic, other metals, etc. In general, the exterior panels of door 116 may be assembled in any suitable manner, e.g., may be secured together using any suitable mechanical fastener, welding, snap-fit mechanisms, etc. In addition, it should be appreciated that an insulating material (not shown), such as fiberglass or foam insulation, may be positioned within door 116 to provide thermal and/or sound insulation to dishwasher 100.

Referring still to FIGS. 1 and 2, user interface panel 164 is positioned proximate top edge 180 of door 116 along the vertical direction V. In this manner, user interface panel 164 may be partially hidden below a countertop when dishwasher appliance 100 is installed below the countertop and door 116 is closed. Accordingly, dishwasher appliance 100 may be referred to as a "top control dishwasher appliance."

However, it should be appreciated that aspects of the present subject matter may be used with dishwasher appliances having other configurations or any other suitable appliance. For example, user interface panel 164 may be alternately positioned on front face or front end 184 of door 116.

User interface panel 164 is positioned on door 116 such that a user can engage or interact with user interface panel 164, e.g., to select operating cycles and parameters, activate/deactivate operating cycles, or adjust other operating parameters of dishwasher appliance 100. User interface panel 164 may include a printed circuit board (not shown) that is positioned within door 116. According to exemplary embodiments, printed circuit board may include or be operatively coupled to controller 160 and/or user interface panel 164. In addition, user interface panel 164 may include or be operably coupled to one or more user inputs or touch buttons (e.g., identified generally herein as user inputs 166) for receiving user input, providing user notifications, or illuminating to indicate cycle or operating status.

Specifically, according to the illustrated embodiment, user inputs 166 include a plurality of capacitive sensors that are mounted to user interface panel 164 and are operable to detect user inputs. For example, these capacitive sensors may be configured for triggering when a user touches a top edge 180 of user interface panel 164 in a region associated with a particular user input 166. In particular, these capacitive sensors can detect when a finger or another conductive material with a dielectric different than air contacts or approaches user interface panel 164, along with the precise location, pressure, etc. of the finger interaction.

When a user touches top edge 180 of user interface panel 164 adjacent one of user inputs 166, the associated capacitive sensors may be triggered and may communicate a corresponding signal to controller 160. In such a manner, operations of dishwasher appliance 100 can be initiated and controlled. According to exemplary embodiments, the capacitive sensors may be distributed laterally on user interface panel 164. It will be understood that other any suitable number, type, and position of capacitive sensors may be used while remaining within the scope of the present subject matter. Indeed, any suitable number, type, and configuration of user inputs 166 may be used while remaining within the scope of the present subject matter.

User interface panel 164 may define a plurality of surfaces that are intended to be illuminated for various purposes. For example, user inputs 166 may be illuminated by light sources to inform the user of the location of the button or to provide some other status indication. Notably, this illumination is typically achieved by directing a light beam along the vertical direction V onto top edge 180 of user interface panel 164. Door 116 may further include a plurality of light sources or lighting devices that are configured for illuminating one or more surfaces of user interface panel 164. It should be appreciated that these light sources may include any suitable number, type, configuration, and orientation of light sources mounted at any suitable location to illuminate status indicators or buttons in any suitable colors, sizes, patterns, etc. In other words, the light sources may be provided as any suitable number, type, position, and configuration of electrical light source(s), using any suitable light technology and illuminating in any suitable color. For example, the light sources may include one or more light emitting diodes (LEDs), which may each illuminate in a single color (e.g., white LEDs), or which may each illuminate in multiple colors (e.g., multi-color or RGB LEDs) depending on the control signal from controller 160.

However, it should be appreciated that according to alternative embodiments, the light sources may include any other suitable traditional light bulbs or sources, such as halogen bulbs, fluorescent bulbs, incandescent bulbs, glow bars, a fiber light source, etc. Moreover, the light sources may be operably coupled (e.g., electrically coupled) to controller 160 or another suitable control board to facilitate activation or illumination of the light sources (e.g., to indicate a user input, state of the dishwasher appliance, state of the wash cycle, or any other relevant information to a user).

According to exemplary embodiments, user interface panel 164 may be any suitable transparent or semitransparent feature for diffusing, directing, or otherwise transmitting light from a light source. For example, user interface panel 164 may be formed from a suitable transparent or translucent material configured to direct light energy, such as a dielectric material, such as glass or plastic, polycarbonate, polypropylene, polyacrylic, or any other suitable material.

In addition, user interface panel 164 may be a dead fronted panel. As used herein, the term "dead front" and the like is generally intended to refer to portions of a control panel which may be used as indicators, buttons, interactive control surfaces, or other user-interaction features without exposing the user to the operating side of the equipment or live parts and connections, i.e., lights, electrical connections, etc. For example, user interface panel 164 may include a transparent or translucent body and an opaque masking material that is selectively printed on top edge 180 of the translucent body to define capacitive touch buttons or user inputs 166.

The opaque material may be deposited on the translucent body to define any suitable number, size, and configuration of illuminated features. These illuminated features may be shapes or include other forms such as symbols, words, etc. that are visible on user interface panel 164. More specifically, when light sources are energized, capacitive touch buttons or user inputs 166 on top edge 180 may be illuminated. Thus, the dead fronted top edge 180 may be the surface that is contacted for controlling dishwasher appliance 100 or which may be illuminated for purposes of indicating operating status or other conditions to the user of the dishwasher appliance 100.

Referring still to FIG. 1, a schematic diagram of an external communication system 190 will be described according to an exemplary embodiment of the present subject matter. In general, external communication system 190 is configured for permitting interaction, data transfer, and other communications between dishwasher appliance 100 and one or more external devices. For example, this communication may be used to provide and receive operating parameters, user instructions or notifications, performance characteristics, user preferences, or any other suitable information for improved performance of dishwasher appliance 100. In addition, it should be appreciated that external communication system 190 may be used to transfer data or other information to improve performance of one or more external devices or appliances and/or improve user interaction with such devices.

For example, external communication system 190 permits controller 160 of dishwasher appliance 100 to communicate with a separate device external to dishwasher appliance 100, referred to generally herein as an external device 192. As described in more detail below, these communications may be facilitated using a wired or wireless connection, such as via a network 194. In general, external device 192 may be any suitable device separate from dishwasher appliance 100 that is configured to provide and/or receive communications, information, data, or commands from a user. In this regard, external device 192 may be, for example, a personal phone, a smartphone, a tablet, a laptop or personal computer, a wearable device, a smart home system, or another mobile or remote device.

In addition, a remote server 196 may be in communication with dishwasher appliance 100 and/or external device 192 through network 194. In this regard, for example, remote server 196 may be a cloud-based server 196, and is thus located at a distant location, such as in a separate state, country, etc. According to an exemplary embodiment, external device 192 may communicate with a remote server 196 over network 194, such as the Internet, to transmit/receive data or information, provide user inputs, receive user notifications or instructions, interact with or control dishwasher appliance 100, etc. In addition, external device 192 and remote server 196 may communicate with dishwasher appliance 100 to communicate similar information.

In general, communication between dishwasher appliance 100, external device 192, remote server 196, and/or other user devices or appliances may be carried using any type of wired or wireless connection and using any suitable type of communication network, non-limiting examples of which are provided below. For example, external device 192 may be in direct or indirect communication with dishwasher appliance 100 through any suitable wired or wireless communication connections or interfaces, such as network 194. For example, network 194 may include one or more of a local area network (LAN), a wide area network (WAN), a personal area network (PAN), the Internet, a cellular network, any other suitable short- or long-range wireless networks, etc. In addition, communications may be transmitted using any suitable communications devices or protocols, such as via Wi-Fi®, Bluetooth®, Zigbee®, wireless radio, laser, infrared, Ethernet type devices and interfaces, etc. In addition, such communication may use a variety of communication protocols (e.g., TCP/IP, HTTP. SMTP, FTP), encodings or formats (e.g., HTML, XML), and/or protection schemes (e.g., VPN, secure HTTP, SSL).

External communication system 190 is described herein according to an exemplary embodiment of the present subject matter. However, it should be appreciated that the exemplary functions and configurations of external communication system 190 provided herein are used only as examples to facilitate description of aspects of the present subject matter. System configurations may vary, other communication devices may be used to communicate directly or indirectly with one or more associated appliances, other communication protocols and steps may be implemented, etc. These variations and modifications are contemplated as within the scope of the present subject matter.

Figure 3:
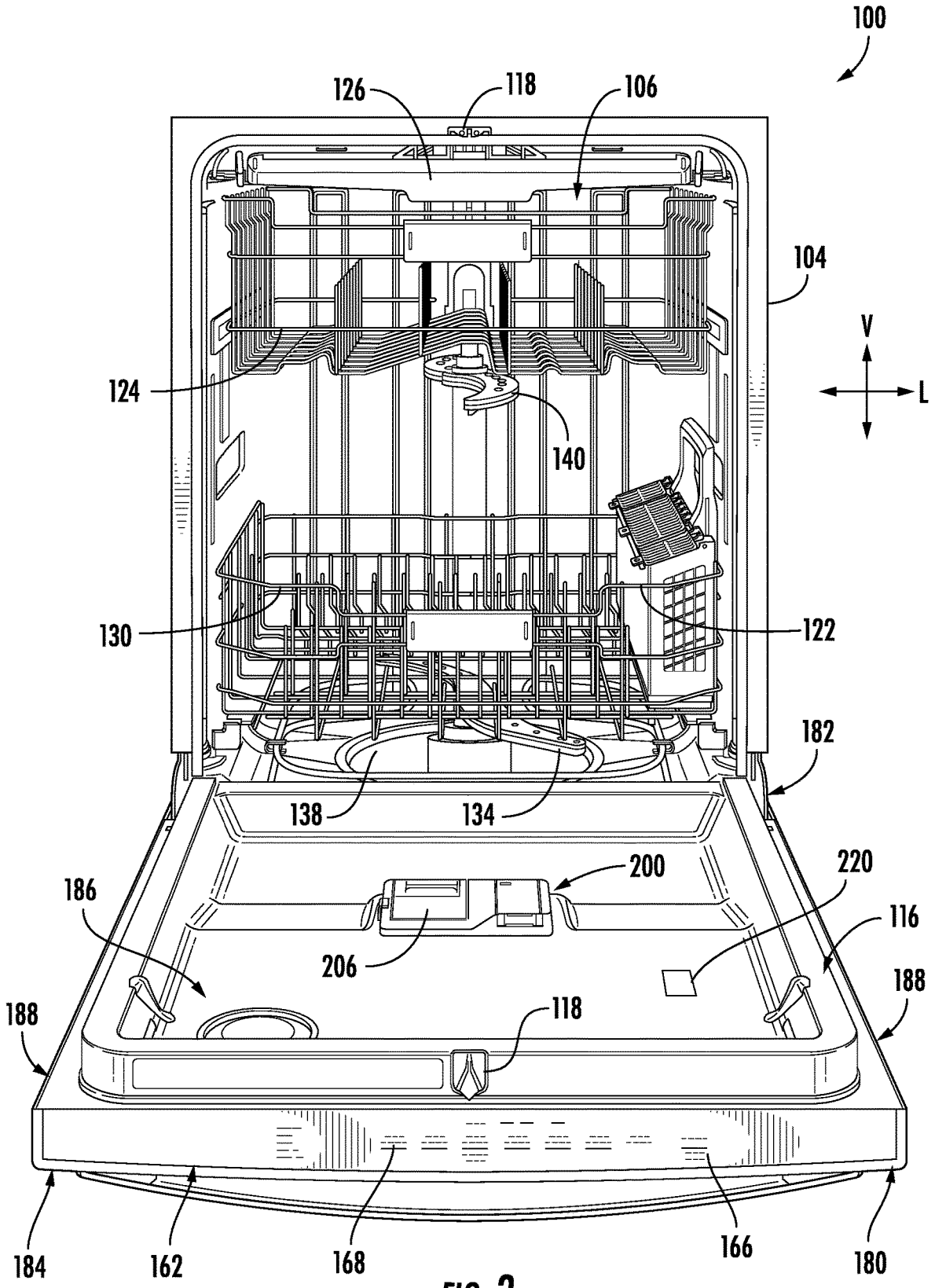
FIG. 3 provides a front view of the exemplary dishwashing appliance of FIG. 1 with a door open according to an example embodiment of the present disclosure.
Figure 4:
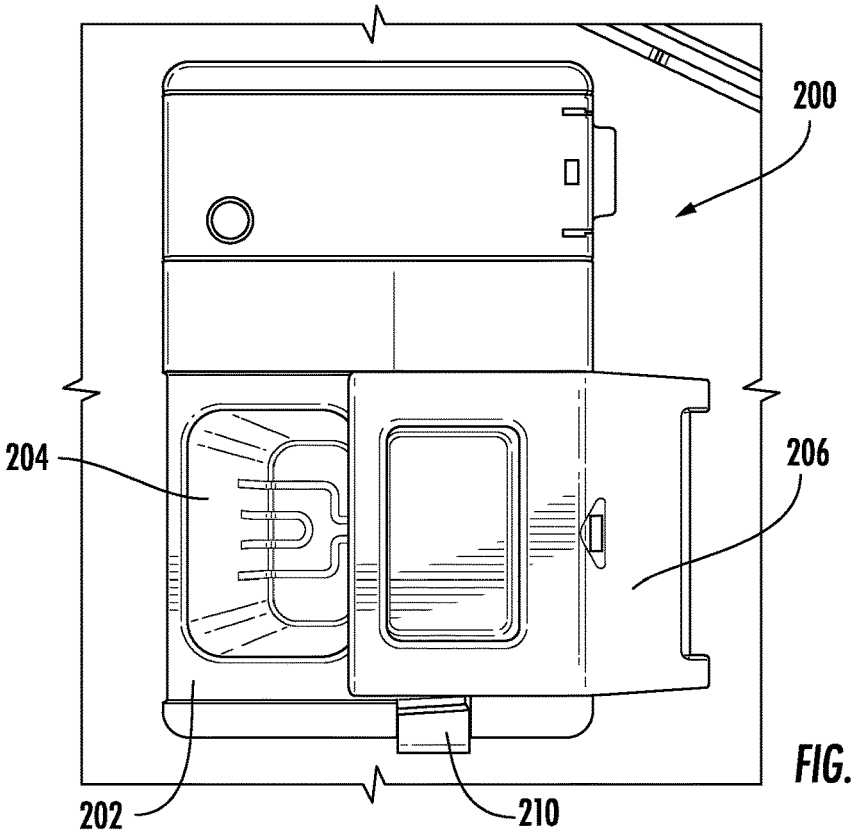
FIG. 4 provides an elevation view of a dispensing assembly on the exemplary door of the dishwasher appliance of FIG. 1 according to an example embodiment of the present subject matter.
Figure 5:
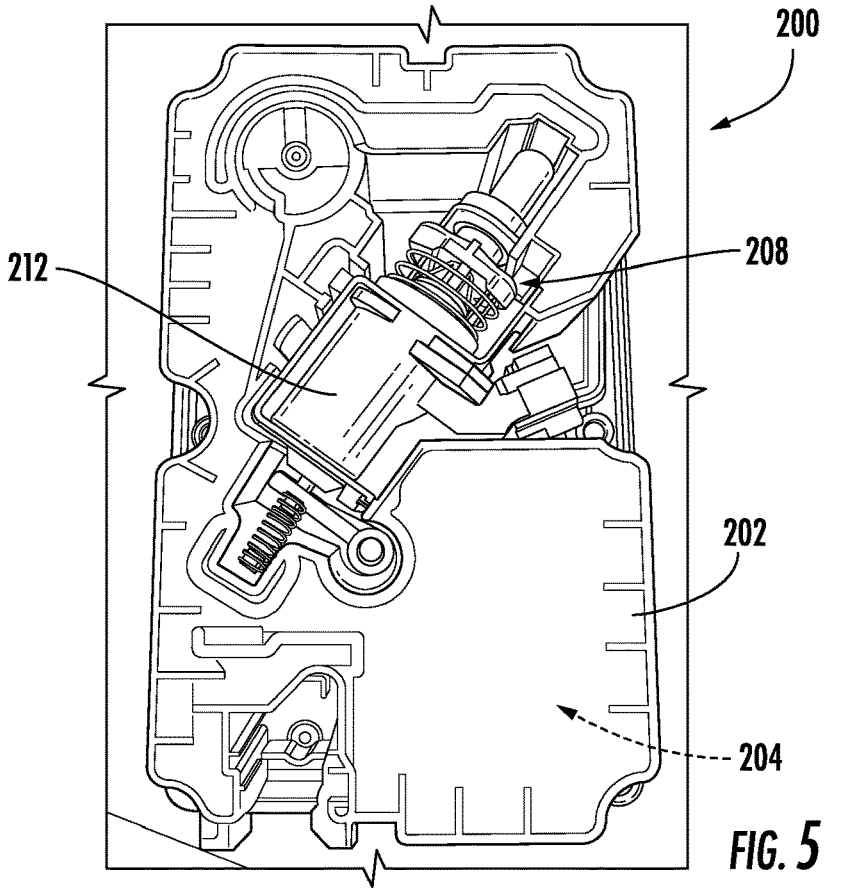
FIG. 5 provides a rear view of the example dispensing assembly of FIG. 4 according to an example embodiment of the present subject matter.

Referring now to FIGS. 3 through 5, dishwasher appliance 100 may further include a dispensing assembly 200 that is generally configured for dispensing wash additives into wash chamber 106 to facilitate a cleaning cycle. According to the illustrated embodiment, dispensing assembly 200 may be mounted to rear end 186 of door 116. Although an exemplary dispensing assembly 200 is described below for use with dishwasher appliance 100, it should be appreciated that variations and modifications may be made to dispensing assembly 200 while remaining within the scope of the present subject matter.

According to the illustrated embodiment, dispensing assembly 200 may generally include a dispenser cup 202 that defines a reservoir 204 for receiving a wash additive, e.g., such as detergent, rinse aid, or any other suitable additive. In addition, dispensing assembly 200 may include a dispenser door 206 that is generally movable between an open position and a closed position to provide selective access to reservoir 204. For example, a user typically loads reservoir 204 with wash additive, e.g., such as a detergent pod or liquid/powdered detergent, closes dispenser door 206, closes door 116, and initiates an operating cycle. Dispensing assembly 200 may further include an actuating mechanism 208 that is generally configured for moving dispenser door 206 from the closed position to the open position. In this regard, controller 160 may be in operative communication with actuating mechanism 208 and may operate actuating mechanism 208 to open dispenser door 206 at a desired time during the cleaning cycle.

According to an example embodiment, dispenser door 206 may be biased toward the open position (as shown in FIG. 4), e.g., using a mechanical spring or other resilient element. Dispensing assembly 200 may further include a latch 210 that secures dispenser door 206 in the closed position. In this manner, after a user adds detergent to reservoir 204, they may pivot dispenser door 206 to the closed position (as shown in FIG. 3), overcoming the force of the mechanical spring until latch 210 engages to secure dispenser door 206 in the closed position. Actuating mechanism 208 may include a solenoid 212 that disengages latch 210 upon receiving a command from controller 160, thereby causing dispenser door 206 to pivot into the open position.

Notably, when dispenser door 206 is released and the mechanical spring urges dispenser door 206 to the open position, noise may be generated as dispenser door 206 reaches the open position and/or slaps against door 116. Notably, in the event of a dispensing assembly 200 failure, dispenser door 206 may not open. As a result, a cleaning cycle may be performed without detergent, resulting in poor cleaning performance and user dissatisfaction. Dispensing assembly failures may occur for a variety of reasons, such as a dispenser door that is jammed or otherwise prevented from opening, e.g., due to build-up of detergent or other grime. Alternatively, actuating mechanism 208 may fail or a component on controller 160 may fail resulting in a lack of power to actuating mechanism 208. Accordingly, aspects of the present subject matter are generally directed to methods for detecting the failure of dispensing assembly 200 and implementing corrective action.

For example, one manner of detecting failure of dispensing assembly 200 may be monitoring sound generated during operation of dispensing assembly 200. Accordingly, dishwasher appliance 100 may include a microphone 220 that is positioned at any suitable location within the vicinity of dishwasher appliance 100 for monitoring sound generated by dishwasher appliance 100. For example, according to the illustrated embodiment, microphone 220 may be positioned within door 116. In general, microphone 220 may be used for monitoring the sound waves, noises, or other vibrations generated during the operation of dishwasher appliance 100. For example, microphone 220 may be one or more microphones, acoustic detection devices, vibration sensors, or any other suitable acoustic transducers that are positioned at one or more locations in or around dishwasher appliance 100.

In addition, controller 160 may include a control board (not shown) that includes relays, transistors, or other electronic components that are configured to provide power to or otherwise actuate actuating mechanism 208. In addition, controller 160 may be capable of monitoring command signals or relays used to regulate actuating mechanism 208 as well as power drawn by actuating mechanism 208. Accordingly, as described in more detail below, controller 160 may monitor the operation of actuating mechanism and may identify the failure of dispensing assembly 200 based at least in part on the operation of actuating mechanism 208.

Now that the construction of dishwasher appliance 100 and dispensing assembly 200 according to exemplary embodiments have been presented, an exemplary method 300 of operating a dishwasher appliance will be described. Although the discussion below refers to the exemplary method 300 of operating dishwasher appliance 100, one skilled in the art will appreciate that the exemplary method 300 is applicable to the operation of a variety of other dishwasher appliances and dispensing assemblies.

In exemplary embodiments, the various method steps as disclosed herein may be performed by controller 160 or a separate, dedicated controller. In this regard, as described herein, controller 160 of dishwasher appliance 100 may implement all steps of method 300. However, it should be appreciated that according to alternative embodiments, controller 160 may offload the analysis described herein, e.g., by sending sound signals and power draw data to remote server 196 for analysis. Other distributed analysis arrangements are possible and within the scope of the present subject matter.

Figure 6:
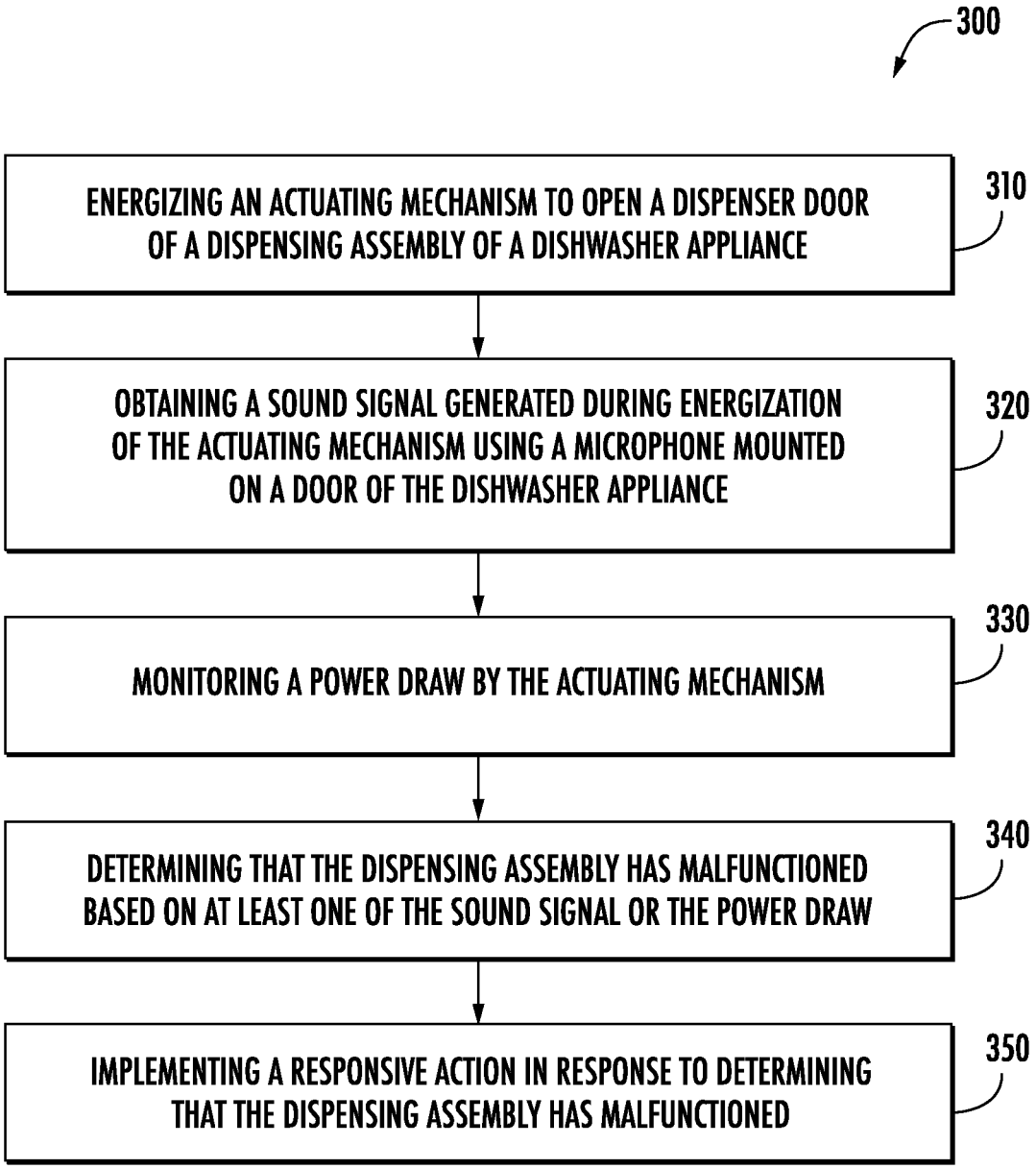
FIG. 6 illustrates a method for operating a dishwasher appliance in accordance with one embodiment of the present disclosure.

Referring now to FIG. 6, method 300 includes, at step 310, energizing an actuation mechanism to open a dispenser door of a dispensing assembly of a dishwasher appliance. In this regard, continuing the example from above, at a target time within an operating cycle of dishwasher appliance 100, controller 160 may operate actuating mechanism 208 with the intention of opening dispenser door 206 and injecting detergent into wash chamber 106. This energization may be achieved by actuating a transistor or relay within controller 160 to deliver power to actuating mechanism 208.

Step 320 generally includes obtaining a sound signals generated during energization of the actuating mechanism using a microphone mounted on a door of the dishwasher appliance. In this regard, during and immediately after energizing actuation mechanism 208, controller 160 may use microphone 220 to monitor sounds or noises generated within and around dishwasher appliance 100. By monitoring the sound generated, controller 160 may identify issues with dispensing assembly 200. such as a jammed dispenser door 206. As explained below, method 300 may utilize sound signals alone to determine the failure of dispensing assembly 200.

However, according to alternative embodiments, method 300 may rely on power draw, controller commands, relay positions, etc. for identifying the failure of dispensing assembly 200. Accordingly, step 330 may include monitoring a power draw by the actuating mechanism. In this regard, controller 160 may monitor the state of relays associated with actuating mechanism 208. In addition, controller 160 may monitor the voltage and/or current supplied to actuating mechanism 208. For example, in a fixed voltage system, the current draw of solenoid 212 may be used to identify issues with the operation of dispensing assembly 200.

Figure 7:
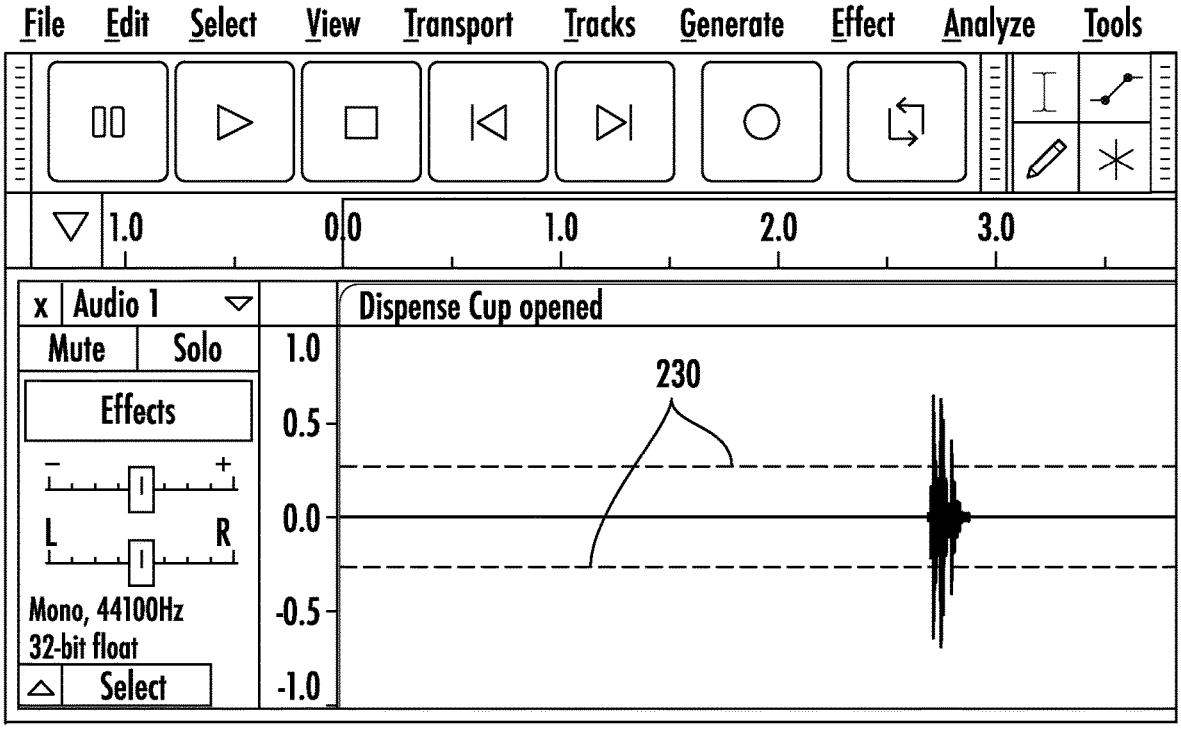
FIG. 7 provides a plot of an audio signal generated when a dispenser door is properly opened according to an example embodiment of the present subject matter.
Figure 8:
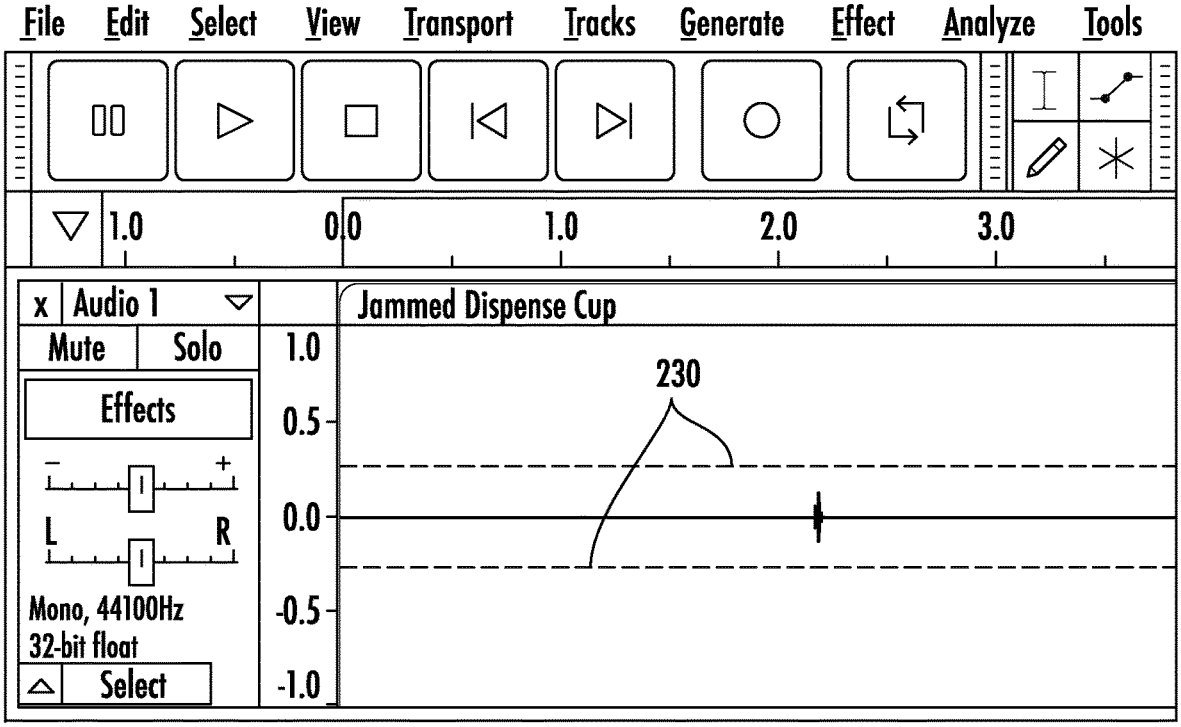
FIG. 8 provides a plot of an audio signal generated when a dispenser door is jammed according to an example embodiment of the present subject matter.

Step 340 may generally include determining that dispensing assembly has malfunctioned based on at least one of the sound signal or the power draw. As explained above, according to an example embodiment, method 300 may include relying on sound signals alone to determine a failure of dispensing assembly 200. In this regard, controller 160 may be programmed with or otherwise know a sound signature associated with normal dispenser cup operation. For example, FIG. 7 illustrates a sound signature generated when dispenser door 206 operates normally, e.g., illustrating a relatively large spike in sound amplitude. By contrast, FIG. 8 illustrates a sound signature generated when dispenser door 206 fails or jams, e.g., illustrating little to no sound generated. Method 300 may include identifying these differences in the sound signal to determine whether dispenser door 206 has opened. For example, step 340 of determining that the dispensing assembly 200 has malfunctioned based at least in part on the sound signal may include determining that an amplitude of the sound signal falls below a predetermined sound threshold (e.g., as identified generally by reference numeral 230 in FIGS. 7 and 8). Although FIGS. 7 and 8 illustrate the determination that the amplitude of the sound signal falls below the predetermined sound threshold, it should be appreciated that step 340 may further include determining that the dispensing assembly 200 has malfunctioned based at least in part on the amplitude of the sound signal exceeding another predetermined sound threshold or otherwise falling outside a desired or expected sound threshold range.

According to still other embodiments, method 300 may include determining that dispensing assembly has malfunctioned based at least in part on the power draw, e.g., either alone or in conjunction with the sound signal. For example, step 340 may include determining that the power draw has increased by a predetermined power threshold relative to the standard power draw. In this regard, if solenoid 212 commonly takes 100 milliamps (mA) of current to open dispenser door 206, but the current power draw of solenoid 212 has increased to 200 or 300 mA this increase in power draw may be sufficient to indicate that there is an issue with opening dispenser door 206. Moreover, if the sound signal has changed relative to a standard sound signal, this may be further evidence that a failure of dispensing assembly 200 has occurred. Method 300 may include using this power draw information and/or sound signal information to identify such failures.

According to example embodiments, step 340 may further include determining that an actuator relay is active while also determining that the power draw from the actuating mechanism 208 is zero or minimal. According to such an embodiment, controller 160 may be attempting to actuate solenoid 212 but solenoid 212 is not drawing power, which may be indicative of a faulty electronic component, a bad relay, a faulty wiring harness, etc.

Step 350 may generally include implementing a responsive action in response to determining that dispensing assembly has malfunctioned. For example, implementing the responsive action may include providing a user notification that dispensing assembly has malfunctioned. This user notification may be communicated to the user in any suitable manner. For example, the user notification may be provided through a user interface panel (such as user interface panel 164), e.g., such as by illuminating a dispensing failure light indicator. According to still other embodiments, the user notification regarding the dispensing failure may be communicated directly to the user through external device 192 (e.g., such as the user's cell phone) via network 194. According to still other embodiments, the user notification may be provided to a smart speaker, to another connected appliance, or any other suitable device. In addition, according to example embodiments, method 300 may include communicating with a service technician, scheduling a maintenance service, ordering a new dispenser part, etc.

FIG. 6 depicts steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of method 300 are explained using dishwasher appliance 100 and dispensing assembly 200 as an example, it should be appreciated that this method may be applied to the operation of any suitable dispensing assembly in any suitable dishwasher appliance.

As explained above, aspects of the present subject matter are generally directed to a feedback algorithm for a dispenser cup in a dishwasher. For example, the feedback algorithm may monitor the condition of the dispenser cup by classifying an audio signature, power draw, and bit mapping as the door is actuated. When the dispenser cup gets mucked up by soap or otherwise jammed, the power draw may increase slightly, and the audio signature will change. When the dispense cup is broken all together, the power draw may decrease to zero, the relay bit mapping may be correct, and the audio signature may be silent. The combination of bit mapping, the audio signature, and the power draw readings may be used to determine the dispenser cup condition. All of the data collected about the dispenser cup may be sent to cloud to analyze the condition of the dispenser cup. The dishwasher may also triangulate the three data points to determine the state of the dispense cup.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance defining a vertical direction, a lateral direction, and a transverse direction, the dishwasher appliance comprising:

a wash tub positioned within a cabinet and defining a wash chamber;

a door pivotally mounted to the cabinet to provide selective access to the wash chamber;

a dispensing assembly comprising a dispenser cup, a dispenser door for providing selective access to the dispenser cup, and an actuating mechanism for moving the dispenser door from a closed position to an open position;

a microphone for monitoring sound generated during operation of the dishwasher appliance; and a controller in operative communication with the dispensing assembly and the microphone, the controller being configured to:

energize the actuating mechanism;

obtain a sound signal generated during energization of the actuating mechanism;

determine that the dispensing assembly has malfunctioned based at least in part on the sound signal; and implement a responsive action in response to determining that the dispensing assembly has malfunctioned based at least in part on the sound signal.

2. The dishwasher appliance of claim 1, wherein determining that the dispensing assembly has malfunctioned based at least in part on the sound signal comprises:

determining that an amplitude of the sound signal falls outside of a predetermined sound threshold range.

3. The dishwasher appliance of claim 1, wherein the controller is further configured to:

monitor a power draw by the actuating mechanism; and determine that the dispensing assembly has malfunctioned based at least in part on the power draw.

4. The dishwasher appliance of claim 3, wherein the controller is further configured to:

determine that the power draw has increased by a predetermined power threshold;

determine sound signal has changed relative to a standard sound signal; and determine that the dispensing assembly is malfunctioning due to a clogged or jammed dispenser door.

5. The dishwasher appliance of claim 3, wherein the controller is further configured to:

determine that an actuator relay is active;

determine that the power draw is zero; and determine that the dispensing assembly is malfunctioning due to a faulty actuating mechanism.

6. The dishwasher appliance of claim 1, wherein the microphone is positioned within the door of the dishwasher appliance.

7. The dishwasher appliance of claim 1, wherein the actuating mechanism comprises a solenoid selectively engaging a latch that secures the dispenser door in the closed position.

8. The dishwasher appliance of claim 1, wherein implementing the responsive action comprises:

providing a user notification that the dispensing assembly has malfunctioned.

9. The dishwasher appliance of claim 8, wherein the user notification is provided through a user interface panel.

10. The dishwasher appliance of claim 8, wherein the controller is in operative communication with a remote device through an external network, and wherein the user notification is provided through the remote device.

11. The dishwasher appliance of claim 10, wherein the remote device comprises at least one of a mobile phone or a smart speaker.

12. The dishwasher appliance of claim 1, wherein the controller is in operative communication with a remote server through an external network, and wherein the controller is configured to send the sound signal or a power draw to the remote server for analysis.

13. A method of operating a dishwasher appliance, the dishwasher appliance comprising a dispensing assembly comprising a dispenser cup, a dispenser door for providing selective access to the dispenser cup, and an actuating mechanism for moving the dispenser door from a closed position to an open position, the dishwasher appliance further comprising a microphone for monitoring sound generated during operation of the dishwasher appliance, the method comprising:

energizing the actuating mechanism;

obtaining a sound signal generated during energization of the actuating mechanism;

determining that the dispensing assembly has malfunctioned based at least in part on the sound signal; and implementing a responsive action in response to determining that the dispensing assembly has malfunctioned based at least in part on the sound signal.

14. The method of claim 13, wherein determining that the dispensing assembly has malfunctioned based at least in part on the sound signal comprises:

determining that an amplitude of the sound signal falls outside of a predetermined sound threshold range.

15. The method of claim 13, further comprising:

monitoring a power draw by the actuating mechanism; and determining that the dispensing assembly has malfunctioned based at least in part on the power draw.

16. The method of claim 15, further comprising:

determining that the power draw has increased by a predetermined power threshold;

determining sound signal has changed relative to a standard sound signal; and determining that the dispensing assembly is malfunctioning due to a clogged or jammed dispenser door.

17. The method of claim 15, further comprising:

determining that an actuator relay is active;

determining that the power draw is zero; and determining that the dispensing assembly is malfunctioning due to a faulty actuating mechanism.

18. The method of claim 13, wherein the microphone is positioned within a door of the dishwasher appliance.

19. The method of claim 13, wherein implementing the responsive action comprises:

providing a user notification that the dispensing assembly has malfunctioned.

20. The method of claim 13, further comprising:

sending the sound signal or a power draw to a remote server for analysis.

* * * * *